US009845799B2

(12) United States Patent
Meza et al.

(10) Patent No.: US 9,845,799 B2
(45) Date of Patent: Dec. 19, 2017

(54) SEALED DIAPHRAGM PUMP

(71) Applicant: Flow Control LLC, Gloucester, MA (US)

(72) Inventors: Humberto V. Meza, Tustin, CA (US); Manuel Villagomez, Corona, CA (US)

(73) Assignee: Flow Control LLC, Beverly, MA (US)

( * ) Notice: Subject to any disclaimer, the term of this patent is extended or adjusted under 35 U.S.C. 154(b) by 765 days.

(21) Appl. No.: 13/681,971

(22) Filed: Nov. 20, 2012

(65) Prior Publication Data

US 2014/0140873 A1 May 22, 2014

(51) Int. Cl.

| | |
|---|---|
| ***F04B 43/02*** | (2006.01) |
| ***F04B 43/04*** | (2006.01) |
| *F04B 43/00* | (2006.01) |

(52) U.S. Cl.

CPC ..... *F04B 43/04* (2013.01); *F04B 43/02* (2013.01); *F04B 43/021* (2013.01); *F04B 43/026* (2013.01); *F04B 43/0054* (2013.01)

(58) Field of Classification Search

CPC ..... F04B 43/04; F04B 43/02; F04B 45/047; F04B 43/026; F04B 43/0054

See application file for complete search history.

(56) References Cited

U.S. PATENT DOCUMENTS

| | | | | |
|---|---|---|---|---|
| 1,792,920 | A | 2/1931 | Myers | |
| 4,207,033 | A | 6/1980 | Drutchas et al. | |
| 4,610,605 | A * | 9/1986 | Hartley | 417/269 |
| 5,154,589 | A | 10/1992 | Ruhl et al. | |
| 5,466,133 | A * | 11/1995 | Tuck, Jr. | 418/2 |
| 5,476,367 | A | 12/1995 | Zimmermann et al. | |
| 5,571,000 | A | 11/1996 | Zimmermann et al. | |
| 5,660,536 | A | 8/1997 | Karls et al. | |
| 5,806,169 | A | 9/1998 | Trago et al. | |
| 5,860,796 | A | 1/1999 | Clausen | |

(Continued)

FOREIGN PATENT DOCUMENTS

| | | |
|---|---|---|
| EP | 0411564 | 2/1991 |
| EP | 411564 A2 * | 2/1991 |

(Continued)

OTHER PUBLICATIONS

JP56077581—1 page English Language Abstract.

(Continued)

*Primary Examiner* — Peter J Bertheaud

(74) *Attorney, Agent, or Firm* — Ware, Fressola, Maguire & Barber LLP

(57) ABSTRACT

A pump includes a molded housing configured with a rear endbell portion to receive an armature and bearing, an intermediate motor portion to receive a motor shell and magnets arranged around the armature, and a front endbell portion to receive a diaphragm assembly having a diaphragm support plate supporting a diaphragm, the rear endbell portion, the intermediate motor portion and the front endbell portion being configured as an integrated molded housing unit, the diaphragm having two circumferential diaphragm sealing surfaces. The pump also includes an upper housing configured to assemble and couple to the molded housing so as to form a circumferential fluid-tight sealing arrangement that is configured between the front endbell portion and the upper housing on only one end of the pump.

20 Claims, 7 Drawing Sheets

(56) References Cited

U.S. PATENT DOCUMENTS

| | | | | |
|---|---|---|---|---|
| 6,020,661 | A | 2/2000 | Trago et al. | |
| 6,022,204 | A | 2/2000 | Murayama et al. | |
| 6,033,193 | A | 3/2000 | Pieters et al. | |
| 6,300,695 | B1 | 10/2001 | Neal | |
| 6,362,554 | B1 | 3/2002 | Neal | |
| 6,437,464 | B1 | 8/2002 | Neal | |
| 6,501,616 | B1 | 12/2002 | Neal | |
| 6,562,460 | B1 | 5/2003 | Bayless | |
| 6,617,721 | B1 | 9/2003 | Neal | |
| 6,623,245 | B2 * | 9/2003 | Meza | F04B 43/0054 417/423.14 |
| 6,733,249 | B2 | 5/2004 | Maier et al. | |
| 6,753,628 | B1 | 6/2004 | Neal | |
| 6,758,656 | B2 | 7/2004 | Maier et al. | |
| 6,833,191 | B2 | 12/2004 | Bayless | |
| 6,840,745 | B1 * | 1/2005 | Macauley | F04B 43/026 137/512.15 |
| 6,844,636 | B2 | 1/2005 | Liu et al. | |
| 6,892,439 | B1 | 5/2005 | Neal et al. | |
| 6,899,958 | B2 | 5/2005 | Bayless | |
| 6,911,166 | B2 | 6/2005 | Neal | |
| 6,941,640 | B2 | 9/2005 | Neal et al. | |
| 7,019,422 | B2 | 3/2006 | Neal et al. | |
| 7,036,207 | B2 | 5/2006 | Neal | |
| 7,049,715 | B2 | 5/2006 | Neal | |
| 7,067,944 | B2 | 6/2006 | Lieu et al. | |
| 7,067,952 | B2 | 6/2006 | Neal | |
| 7,154,200 | B2 | 12/2006 | Neal | |
| 7,190,548 | B2 | 3/2007 | Neal et al. | |
| 7,262,527 | B2 | 8/2007 | Neal | |
| 7,297,404 | B2 | 11/2007 | Bayless | |
| 7,520,720 | B2 | 4/2009 | Welch | |
| 7,566,205 | B2 | 7/2009 | Kinugawa | |
| 7,566,999 | B2 | 7/2009 | Neal | |
| 7,629,716 | B2 | 12/2009 | Neal | |
| 7,683,509 | B2 | 3/2010 | Neal | |
| D657,800 | S * | 4/2012 | Villagomez et al. | D15/7 |
| 9,719,502 | B2 * | 8/2017 | Wylie | F04B 43/026 |
| 2006/0204367 | A1 * | 9/2006 | Meza et al. | 417/53 |
| 2007/0086888 | A1 * | 4/2007 | Patel et al. | 415/177 |
| 2008/0003120 | A1 * | 1/2008 | Meza | F04B 43/026 417/413.1 |
| 2008/0075610 | A1 | 3/2008 | Bonniface et al. | |
| 2010/0068082 | A1 | 3/2010 | Cai et al. | |

FOREIGN PATENT DOCUMENTS

| | | |
|---|---|---|
| JP | 54116707 | 9/1979 |
| JP | 56077581 | 6/1981 |
| WO | 9012962 | 11/1990 |
| WO | WO 9012962 A1 * | 11/1990 |

OTHER PUBLICATIONS

JP54116707—1 page English Language Abstract.

International Search Report and Written Opinion dated Apr. 14, 2014 for International Application No. PCT/US2013/070739, 9 pages.

* cited by examiner

*FIG. 1*: Example of a Known Pump (Prior Art)

*FIG. 3*: Sise–by–side Comparisons

SEALED DIAPHRAGM PUMP

BACKGROUND OF THE INVENTION

1. Field of the Invention

The present invention relates to a pump; and more particularly relates to a diaphragm pump.

2. Brief Description of Related Art

Current diaphragm pump designs use two endbells and a sealing arrangement that includes a combination of an O-ring, gasket, etc. on each end for sealing the motor to prevent intrusion of fluids. FIG. 1 shows an example of one such current diaphragm pump design. In particular, a rear endbell and an intermediate housing portion on one end are sealed with one O-ring seal that forms one leak path, and a front endbell and the intermediate housing portion on another end are sealed with another O-ring seal that forms another leak path. There are also other leak paths, e.g., including a grommet/wire leak path, through the rear endbell on one end, as well as a front endbell and diaphragm support assembly leak path on the other end. With the current prior art technique, there are too many undesirable leak paths that allow fluids to enter the motor. In view of this, there is a need in the marketplace for an improved pump that overcomes these shortcomings.

SUMMARY OF THE INVENTION

The present invention provides apparatus in the form a pump, a diaphragm pump, or an encapsulated diaphragm pump, according to some embodiments of the present invention.

By way of example, the pump may include a molded housing in combination with an upper housing.

The molded housing may be configured with a rear endbell portion to receive an armature and bearing, an intermediate motor portion to receive a motor shell and magnets arranged around the armature, and a front endbell portion to receive a diaphragm assembly having a diaphragm support plate supporting a diaphragm. The rear endbell portion, the intermediate motor portion and the front endbell portion may be configured as an integrated molded housing unit.

The upper housing may be assembled and coupled to the molded housing so as to form a circumferential fluid-tight sealing arrangement that is configured between the front endbell portion and the upper housing on only one end of the encapsulated diaphragm pump.

According to some embodiments of the present invention, the diaphragm may be configured with two circumferential diaphragm sealing surfaces; and the upper housing may include a circumferential upper housing portion configured to cause at least part of a circumferential fluid-tight seal between the two circumferential diaphragm sealing surfaces and corresponding sealing surfaces of the check valve assembly and the diaphragm support plate when the front endbell is assembled and coupled to the upper housing.

According to some embodiments of the present invention, the two circumferential diaphragm sealing surfaces may include a first circumferential diaphragm sealing surface on a first side configured to make sealing contact with a corresponding circumferential sealing surface of a check valve assembly, and may also include a second circumferential diaphragm sealing surface on a second side configured to make sealing contact with a circumferential support plate sealing surface of the support plate.

According to some embodiments of the present invention, the encapsulated diaphragm pump may include one or more of the following features:

The circumferential upper housing portion may be configured as, or take the form of, a circumferential rim.

The first circumferential diaphragm sealing surface may be configured to receive, engage and interlock with the corresponding circumferential sealing surface of the check valve assembly.

The first circumferential diaphragm sealing surface may be configured with inner and outer circumferential diaphragm sealing rims so as to form a U-shaped circumferential diaphragm sealing channel.

The corresponding circumferential sealing portion of the check valve assembly may be configured with corresponding inner and outer circumferential sealing rims so as to form a corresponding U-shaped circumferential sealing channel.

The U-shaped circumferential diaphragm sealing channel may be configured to receive the outer circumferential sealing rim of the check valve assembly in an interlocking manner, and the corresponding U-shaped circumferential sealing channel of the check valve assembly may be configured to receive the inner circumferential diaphragm sealing rim in a corresponding interlocking manner.

The outer circumferential diaphragm sealing rim may be configured to contact the corresponding outer circumferential sealing rim of the check valve assembly, and the corresponding inner circumferential sealing rim of the check valve assembly may be configured to contact the inner circumferential diaphragm sealing rim.

The circumferential extended rim portion of the upper housing may be configured to engage or contact the outer circumferential diaphragm sealing rim.

The circumferential fluid-tight seal may be configured as, or take the form of, a circumferential interlocking seal about and between respective sealing surfaces of the diaphragm and check valve assembly, corresponding to where the molded housing and the upper housing come in contact and meet.

The front endbell portion may be configured to receive the diaphragm support plate and a wobble plate assembly.

The molded housing may be molded around the motor shell.

The rear endbell portion may be configured to form a cavity portion dimensioned to receive a tolerance ring to fit the bearing in the cavity.

The intermediate motor portion may have a substantially cylindrical shape and the front endbell portion may have a flared-out shape so as to spread outwardly from the intermediate motor portion.

The upper housing may have a corresponding flared-out shape for mating with the front endbell.

The pump may include a further circumferential seal or sealing arrangement configured between a circumferential portion of the front endbell portion and a corresponding circumferential portion of the diaphragm support plate, so as to form another part of the circumferential fluid-tight seal between the front endbell portion and the upper housing.

BRIEF DESCRIPTION OF THE DRAWING

The drawing, which are not necessarily drawn to scale, includes the following Figures:

FIG. 2*a* is a side cross-sectional view of a mold having a motor shell inserted therein, and FIG. 2*a'* is a perspective view of the motor shell shown in FIG. 2*a*.

FIG. 2*b* is a side cross-sectional view of a housing having the mold with the motor shell shown in FIG. 2*a* inserted therein, and FIG. 2*b*' is a perspective view of the housing shown in FIG. 2*b*.

FIG. 2*c* is a side cross-sectional view of the housing shown in FIGS. 2*b* and 2*b*' having an armature with bearings, a front end bell and a brushcard installed therein, and FIG. 2*c*' is a perspective view of the housing shown in FIG. 2*c*.

FIG. 2*d* is a side cross-sectional view of the housing shown in FIGS. 2*c* and 2*c*' having a diaphragm support plate and wobble plate assembly installed therein, and FIG. 2*d*' is a perspective view of the housing shown in FIG. 2*d*.

FIG. 2*e* is a side cross-sectional view of the housing shown in FIGS. 2*d* and 2*d*' having a check valve assembly installed to a diaphragm shown in FIG. 2*d*, and FIG. 2*e*' is a perspective view of the housing shown in FIG. 2*e*.

FIG. 2*f* is a side cross-sectional view of the housing shown in FIGS. 2*e* and 2*e*' having an upper housing installed thereto, and FIG. 2*f'* is a perspective view of the housing and upper housing shown in FIG. 2*f*.

FIG. 3 includes FIGS. 3*a* and 3*b* that show side-by-side comparisons of the existing design known in the prior art and the encapsulation design according to some embodiments of the present invention, where

Figure 1:
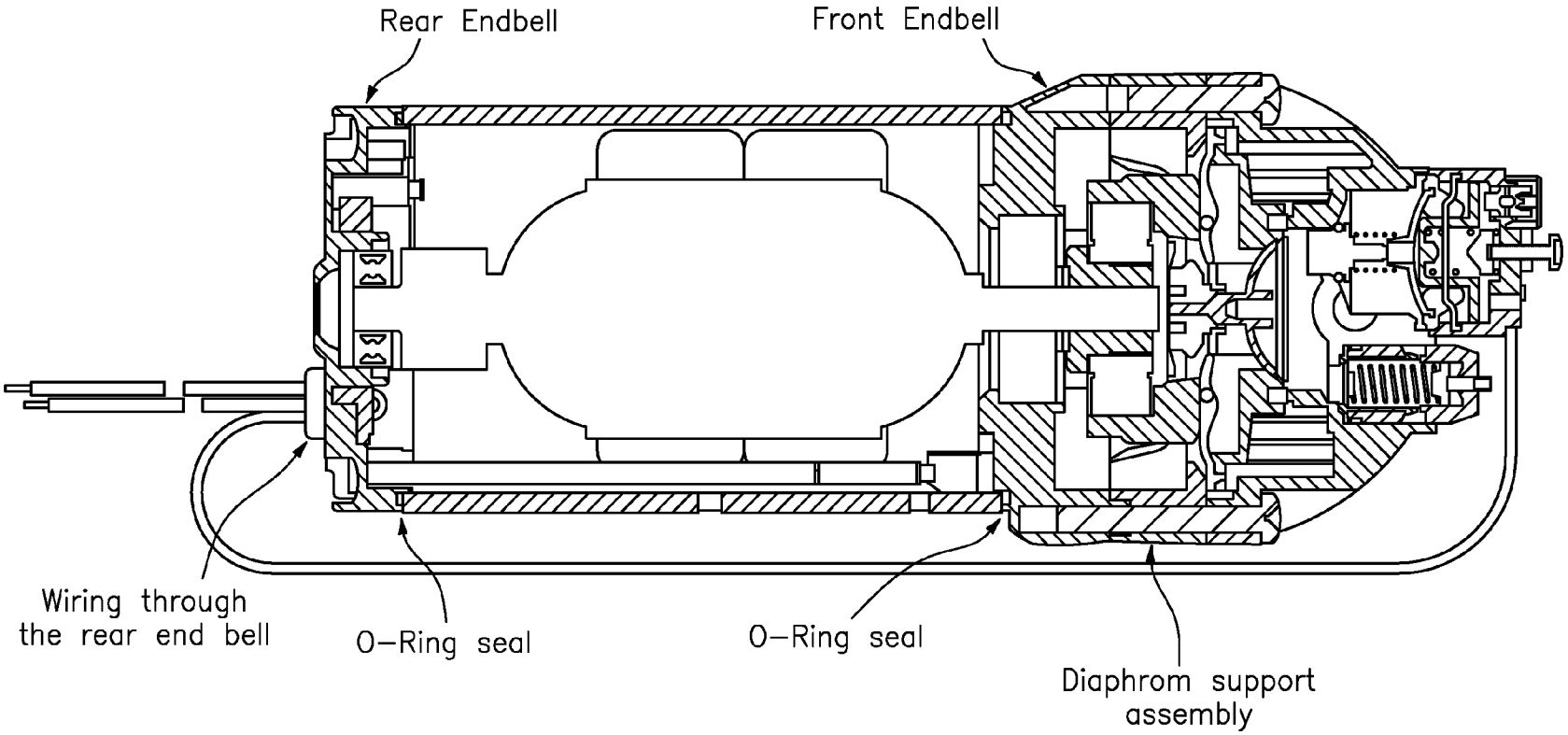
FIG. 1 is a side view of a diaphragm pump that is known in the prior art.

Figures in the drawing are populated with lead lines and reference numerals so as to read consistent with the specification. However, for the sake of reducing clutter in the drawing as a whole, each Figures does not contain every lead line and reference numeral from every other figure.

DETAILED DESCRIPTION OF THE INVENTION

Figure 2:
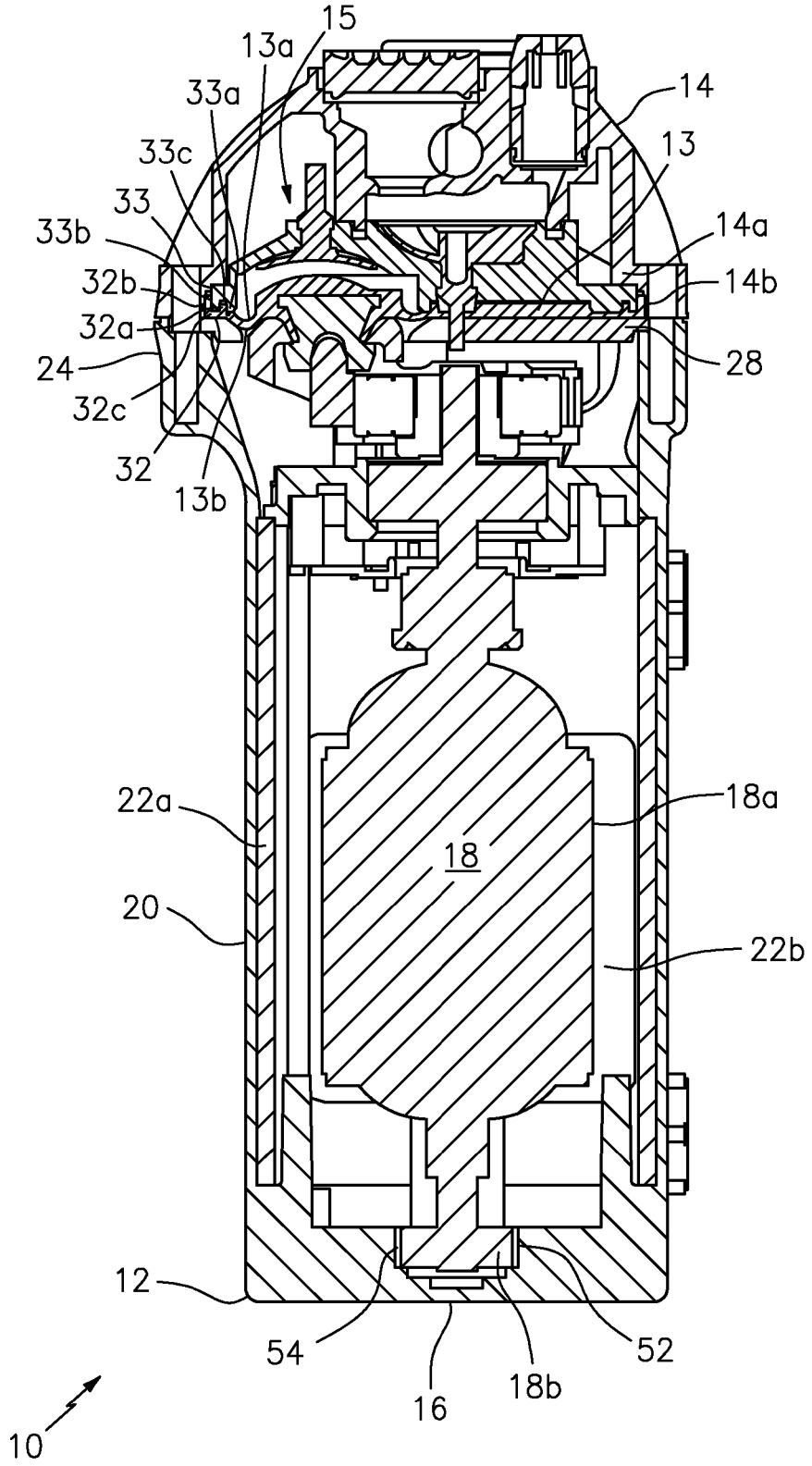
FIG. 2 shows an encapsulated diaphragm pump that is fully assembled, according to some embodiments of the present invention.

By way of example, FIG. 2 shows a new and unique encapsulation diaphragm pump design generally indicated as 10, according to some embodiments of the present invention. In FIG. 2, the encapsulation diaphragm pump 10 is shown fully assembled with parts and components identified with lead lines and reference numerals. FIGS. 2*a* through 2*f'* show a series of steps indicating how the diaphragm pump 10 is assembled so as to form the encapsulation diaphragm pump 10 according to the some embodiment of the present invention. The fully assembled encapsulation diaphragm pump 10 shown in FIG. 2 is an enlarged view of the pump shown in FIG. 2*f*, with the exception that FIG. 2*f* does not include many of the lead lines and reference numeral shown in FIG. 2.

In FIG. 2, the encapsulation diaphragm pump design 10 features a two-part housing arrangement having a molded housing 12 in combination with an upper housing 14. Consistent with that described below, at least part of a circumferential fluid-tight seal may be configured between surfaces or portions of a diaphragm 13 and corresponding surfaces or portions of a check valve assembly generally indicated as 15 and a diaphragm support plate 28 when the molded housing 12 and the upper housing 14 are assembled or coupled together.

In particular, the molded housing 12 may be configured with a rear endbell portion 16 to receive an armature and bearings combination 18, an intermediate motor portion 20 to receive a motor shell 22*a* and magnets 22*b* generally indicated as 22 (see FIG. 2*a*) arranged around an armature portion 18*a* of the combination 18, and a front endbell portion 24 to receive a diaphragm assembly having the diaphragm support plate 28 supporting the diaphragm 13. The rear endbell portion 16, the intermediate motor portion 20 and the front endbell portion 24 are configured as part of an integrated molded housing unit 12. The diaphragm 13 has two sides 13*a*, 13*b*, each having a respective circumferential diaphragm sealing surface or portion 32, 32'.

Figure 2A:
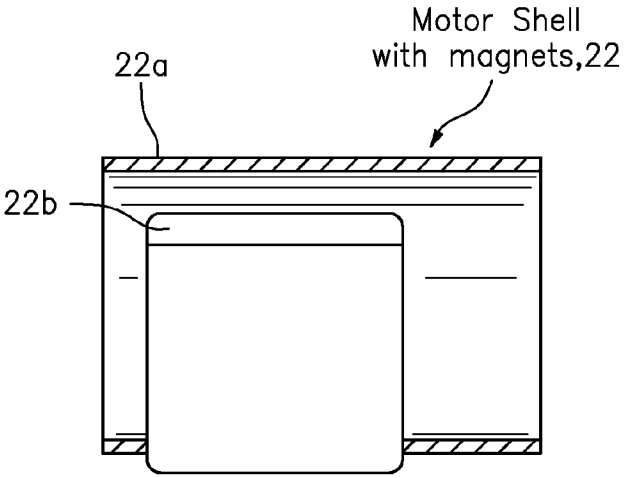
FIGS. 2*a* to 2*f'* show a series of steps for assembling the encapsulated diaphragm pump shown in FIG. 2.
Figure 2A:
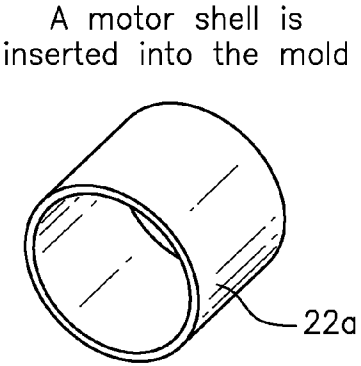

By way of example, on the one side 13*a* the diaphragm 13 may include a first circumferential diaphragm sealing surface or portion 32 configured to make sealing contact with a corresponding circumferential sealing surface 33 of the check valve assembly 15, so as to form at least part of the circumferential fluid-tight seal. In particular, as shown in FIGS. 2 and 2*g*, the circumferential diaphragm sealing surface or portion 32 may be configured to receive and interlock with the corresponding circumferential sealing surface or portion 33 of the check valve assembly 15. For example, the circumferential diaphragm sealing surface or portion 32 may be configured with inner and outer circumferential diaphragm sealing rims 32*a* and 32*b* so as to form a U-shaped circumferential diaphragm sealing channel 32*c*. The corresponding circumferential sealing portion 33 of the check valve assembly 15 may be similarly configured with corresponding inner and outer circumferential sealing rims 33*a* and 33*b* so as to form a corresponding U-shaped circumferential sealing channel 33*c*. As best shown in FIGS. 2, 2*f* and 2*g*, the U-shaped circumferential diaphragm sealing channel 32*c* of the diaphragm 13 may be configured to receive, engage and interlock in a sealing manner with the outer circumferential sealing rim 33*b* of the check valve assembly 15, and the corresponding U-shaped circumferential sealing channel 33*c* of the check valve assembly 15 may be configured to receive, engage and interlock in a corresponding sealing manner with the inner circumferential diaphragm sealing rim 32*a*. The outer circumferential diaphragm sealing rim 32*b* of the diaphragm 13 may be configured to contact and engage the corresponding outer circumferential sealing rim 33*b* of the check valve assembly 15, and the corresponding inner circumferential sealing rim 33*a* of the check valve assembly 15 may be configured to contact and engage the inner circumferential diaphragm sealing rim 32*a* of the diaphragm 13. The sealing engagement between the surface or portion 32 of the diaphragm 13 and the corresponding surface or portion 33 of the check valve assembly 15 combine to form at least part of the circumferential fluid-tight seal when the molded housing 12 and the upper housing 14 are assembled or coupled together. The scope of the invention is not intended to be limited to the specific engagement and interlocking between the surface or portion 32 of the diaphragm 13 and the corresponding surface or portion 33 of the check valve assembly 15 disclosed herein; and embodiments are envisioned having other types or kind of engagement and/or interlocking between other types or kinds of surfaces or portions of the diaphragm 13 and other types or kinds of corresponding surfaces or portions of the check valve assembly 15 both now known and later developed in the future, e.g., including corresponding convex and concave surfaces or portions, or corresponding saw-toothed surfaces or portions.

The upper housing 14 may be configured to assemble or couple to the molded housing 12. By way of example, the upper housing 14 may include a circumferential rim portion 14*a* configured to cause at least part of the circumferential fluid-tight seal between the two circumferential diaphragm sealing surfaces and corresponding sealing surfaces of the check valve assembly 15 and the diaphragm support plate 28, when the upper housing 14 is assembled and coupled to the molded housing 12, consistent with that disclosed herein.

Further, by way of example, on the other side 13*b* the diaphragm 13 may be configured with another circumferential sealing surface or portion 32' to make corresponding circumferential sealing contact with a corresponding circumferential sealing surface or portion 33' of the diaphragm support plate 28 so as to form at least part of the circumferential fluid-tight seal, as best shown in FIGS. 2 and 2*g*.

Furthermore, by way of example, the pump 10 may also include a further circumferential seal or sealing arrangement 35 configured between the front endbell portion 24 and the diaphragm support plate 28, so as to form another part of the circumferential fluid-tight seal between the molded housing 12 and the upper housing 14. In particular, the further circumferential seal or sealing arrangement 35 may be configured between an inner circumferential front endbell portion 24*a* of the front endbell portion 24 and a corresponding circumferential flanged portion 28*a* of the diaphragm support plate 28, so as to form the other part of the circumferential fluid-tight seal. The further circumferential seal or sealing arrangement may also take the form of a gasket or an O-ring between corresponding surfaces or portions of the front endbell portion 24 and the diaphragm support plate 28 However, and in spite of this, the scope of the invention is intended to include other types or kinds of further circumferential seal or sealing arrangements between the front endbell portion 24 and the diaphragm support plate 28*c* within the spirit of the underlying invention.

Moreover, the upper housing 14 may also include a circumferential extended rim portion 14*b* configured to engage the outer circumferential diaphragm sealing rim 32*b* of the diaphragm 13 resting against the corresponding outer circumferential sealing rim 33*b* of the check valve assembly 15. As shown in FIGS. 2 and 2*g*, this part of the circumferential fluid-tight seal may take the form of a circumferential interlocking sealing engagement about and between the respective sealing portions 32 and 33 of the diaphragm 13 and check valve assembly 15, corresponding to where the molded housing 12 and the upper housing 14 come in contact and meet, consistent with that disclosed herein. One advantage of the present invention is that this substantially fluid-tight seal reduces the number of undesirable leak paths that allow fluids to enter the motor that plagued the prior art pump design, including eliminating any leak path between the rear endbell portion 16 and the intermediate housing portion 20.

Figure 3A:
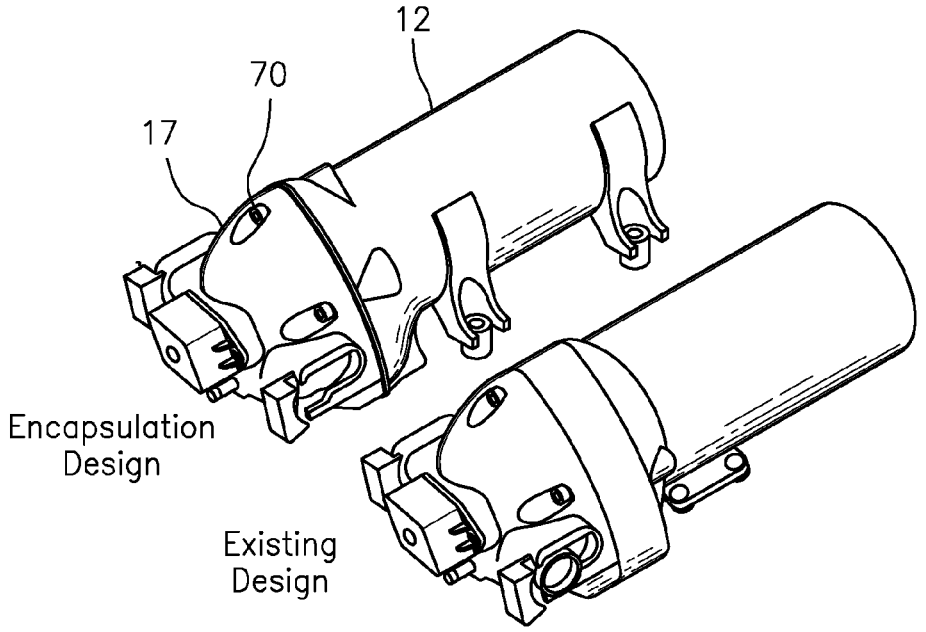
FIG. 3*a* is a top front perspective view of one side-by-side comparison.
Figure 3B:
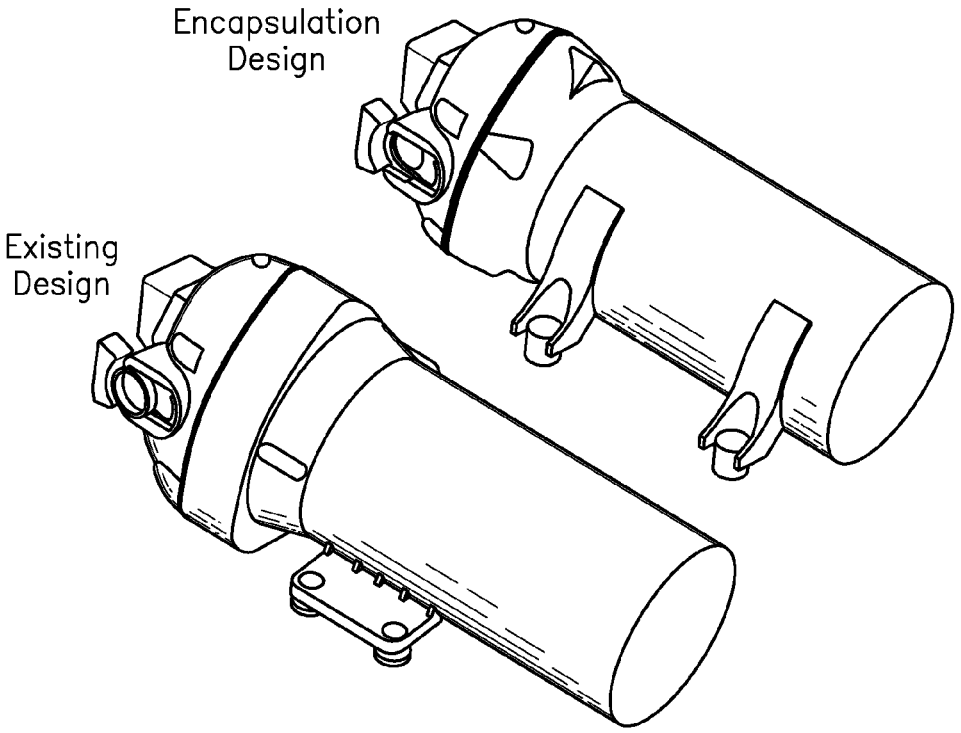
FIG. 3*b* is a top back perspective view of the side-by-side comparison in FIG. 3*a*.

This part of the circumferential fluid-tight seal may be formed by, or the result of, the molded housing 12 and the upper housing 14 being assembled or coupled together using one or more screws or bolts 70 (see FIG. 3*a*), consistent with that disclosed herein, so as to cause, e.g., a compressive sealing force between the surface or portion of the diaphragm 13 and the corresponding surface or portion of the check valve assembly 15 and the diaphragm support plate 28. The scope of the invention is not intended to be limited to the specific manner in which the molded housing 12 and the upper housing 14 are assembled or coupled together. For example, embodiments are envisioned having other types or kind of techniques for assembling and coupling the molded housing 12 and the upper housing 14 together, including using a hinge and latching technique, as well as other types or kinds of assembly or coupling techniques both now known and later developed in the future.

Figure 2B:
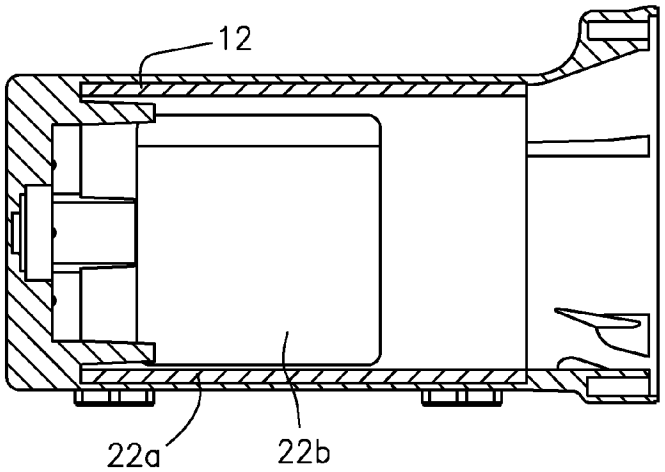
Figure 2B:
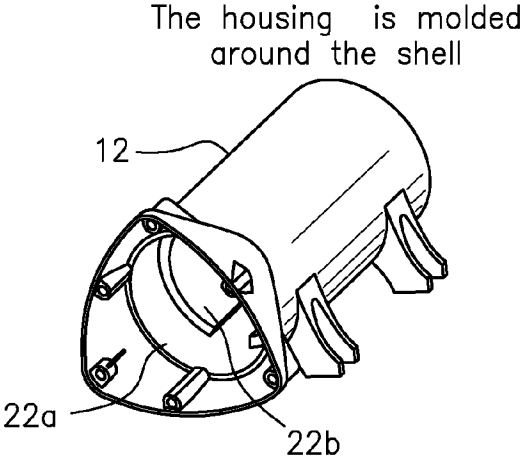

As shown in FIG. 2*b*, the molded housing 12 may be molded around the motor shell 22. As shown in FIG. 2*d*, the front endbell portion 24 may be configured to receive the diaphragm support plate 28 and a wobble plate assembly 50. As shown in FIG. 2*h*, the rear endbell portion 16 may be configured to form a cavity portion 52 dimensioned to receive a tolerance ring 54 to fit a bearing portion 18*b* of the combination 18 in the cavity portion 52. The intermediate motor portion 20 may have a substantially cylindrical shape, and the front endbell portion 24 may have a flared-out shape so as to spread outwardly from intermediate motor portion 20, as shown, and the upper housing 14 may have a corresponding flared-out shape for mating with the front endbell 24.

By integrating the rear end bell 16 and diaphragm assembly 26 into one piece, the pump can be assembled with only the need to seal the front section, consistent with that shown in FIGS. 2 and 2*a* through 2*g*.

FIGS. 2*a* to 2*h*

FIGS. 2*a* to 2*h* set forth a series of steps showing how the diaphragm pump according to the present invention is assembled.

In FIGS. 2*a* and 2*a*', the motor shell and magnets generally indicated in combination as 22 in FIG. 2*a*' is configured and dimensioned so as to be inserted in a mold 22*a* as shown in FIG. 2*a*.

In FIGS. 2*b* and 2*b*', the mold housing 12 is molded around the motor shell and magnets 22.

Figure 2C:
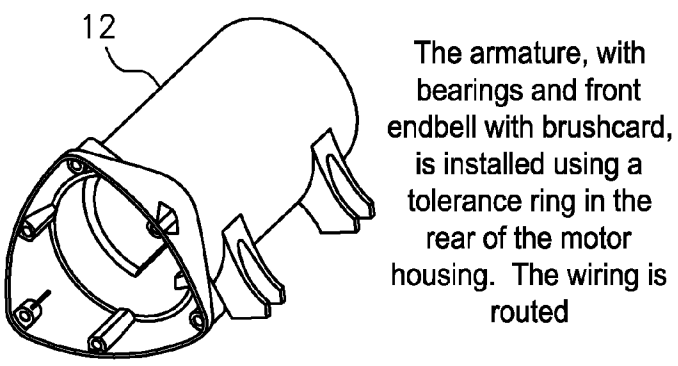
Figure 2C:
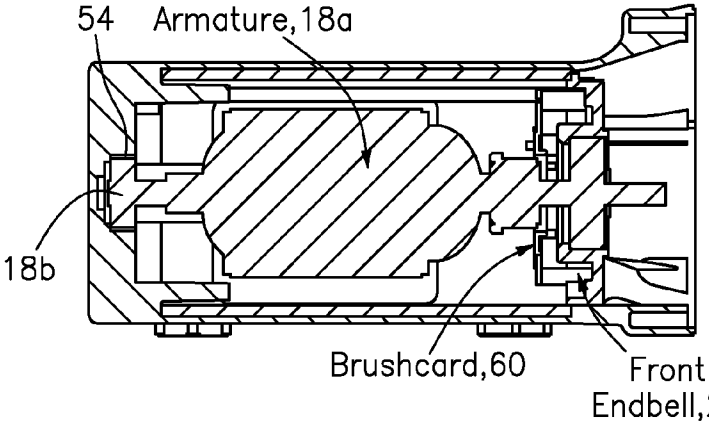
Figure 2D:
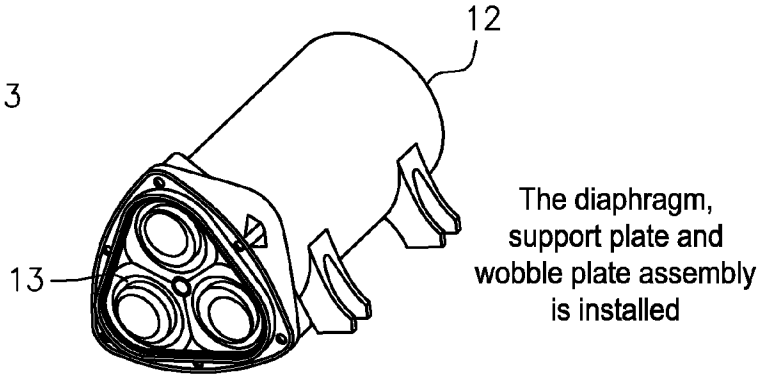
Figure 2D:
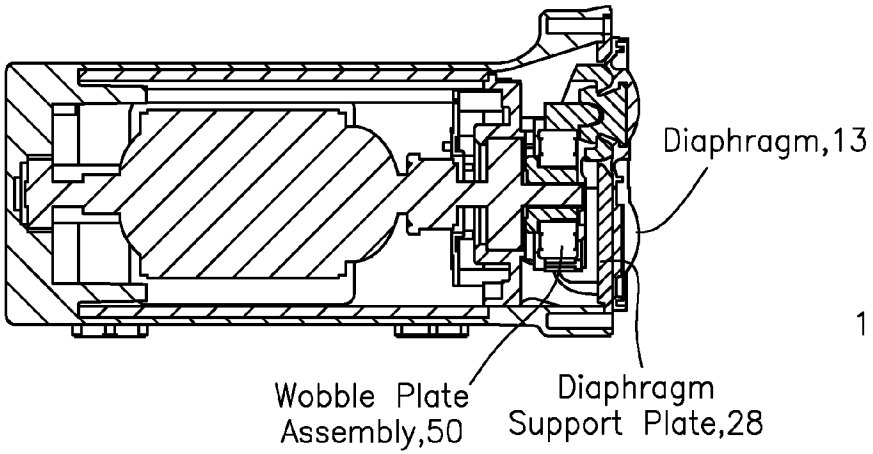

In FIGS. 2*c* and 2*c*', the armature and bearings 18 and the front end bell portion 24 and a brushcard 60 may be installed using the tolerance ring 54 in the rear endbell portion 16 of the molded motor housing 12. Suitable wiring for providing power may be also routed through the front endbell portion 24 and out through, e.g., a grommet (not shown).

In FIGS. 2*d* and 2*d*', the diaphragm support plate 28 and wobble plate assembly 50 may be installed, as shown.

Figure 2E:
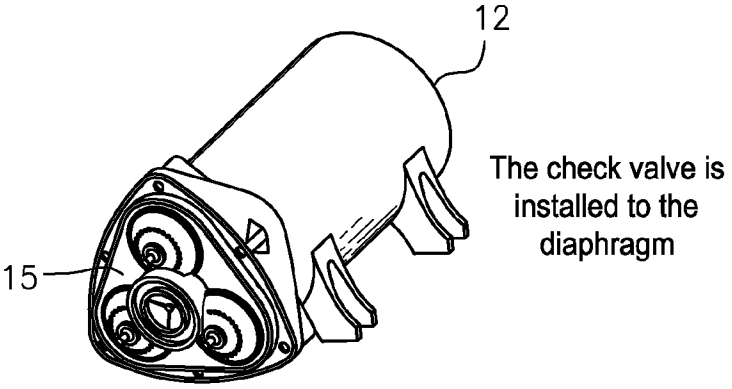
Figure 2F:
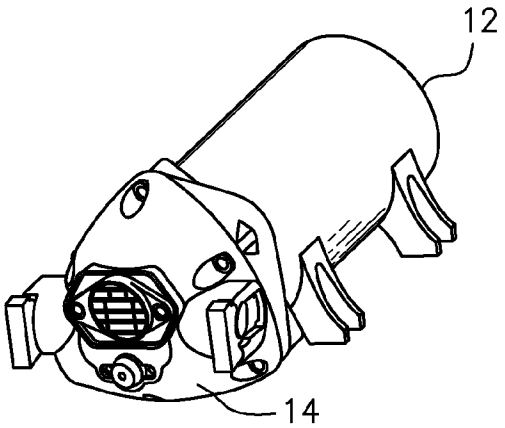
Figure 2E:
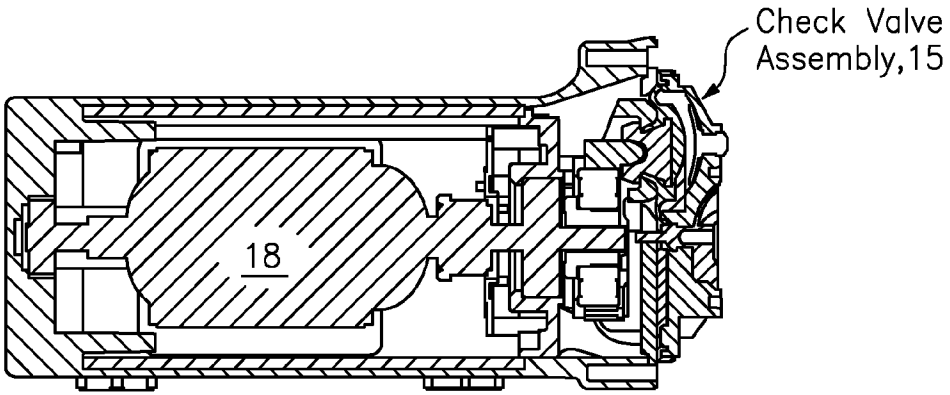
Figure 2F:
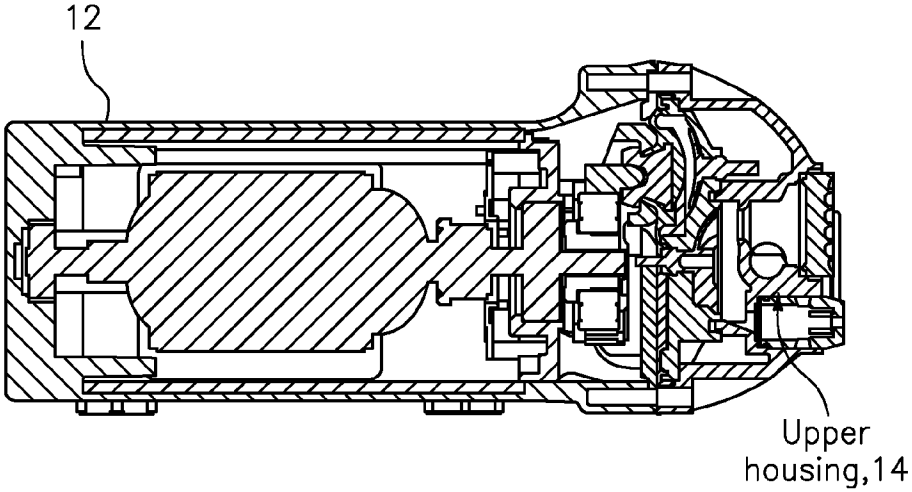
Figure 2G:
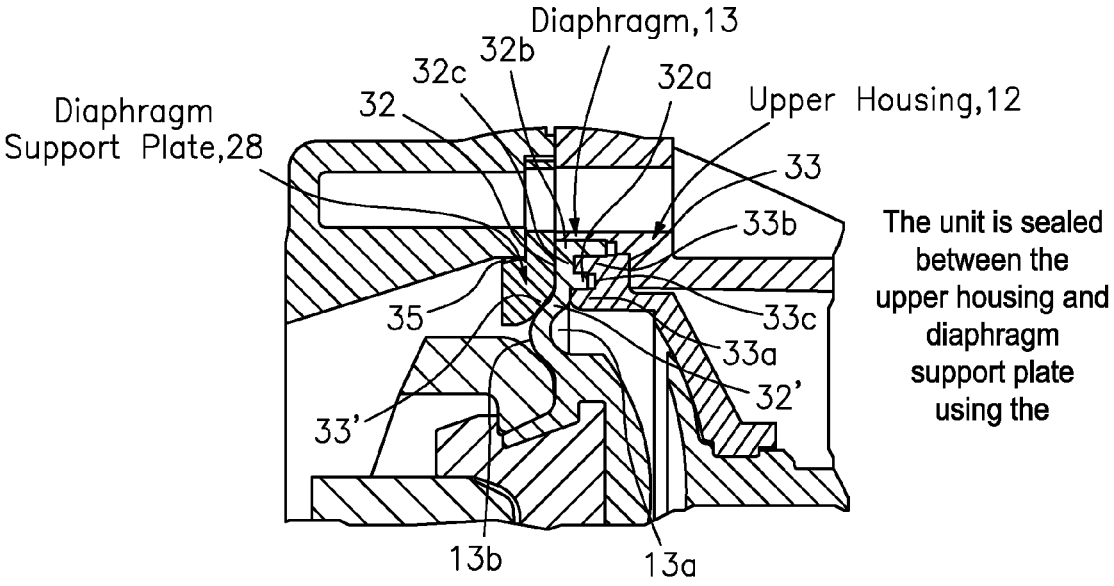
FIG. 2*g* is a partial side cross-sectional view of the housing and the upper housing shown in FIG. 2*f* showing an enlarged view of a seal provided by the diaphragm shown in FIGS. 2*d* and 2*d*' between the housing and the upper housing shown in FIG. 2*f*.
Figure 2H:
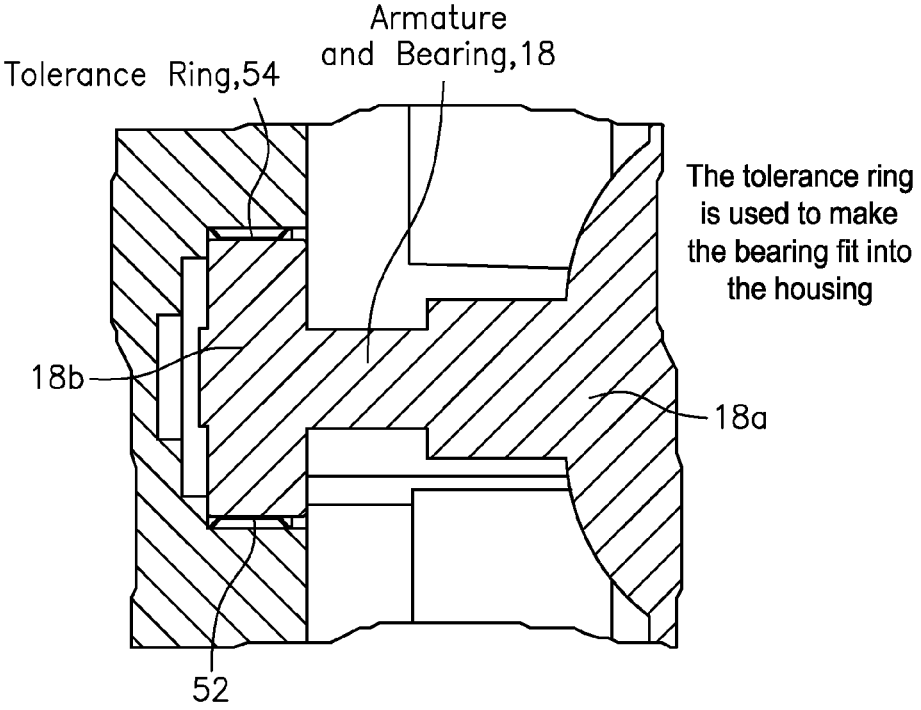
FIG. 2*h* is a partial side cross-sectional view of the housing and the upper housing shown in FIG. 2*f* showing an enlarged view of a tolerance ring arranged between the armature and bearing and the housing, shown on the left side of FIG. 2*c*.

In FIGS. 2*e* and 2*e*', the check valve assembly 34 may be installed to the diaphragm 13.

In FIGS. 2*f* and 2*f*', the upper housing 14 may be installed to the molded housing 12.

FIG. 2*g* shows that the pump unit is sealed between the upper housing 14 and the diaphragm support plate 28 using the diaphragm 13.

FIG. 2*h* shows how the tolerance ring 54 is used to make the bearing portion 18*b* of the combination 18 fit into the molded housing 12.

LIST POSSIBLE APPLICATIONS

By way of example, possible applications of some embodiments of the present invention include any application that requires a diaphragm pump.

THE SCOPE OF THE INVENTION

Further still, the embodiments shown and described in detail herein are provided by way of example only; and the scope of the invention is not intended to be limited to the particular configurations, dimensionalities, and/or design details of these parts or elements included herein. In other words, a person skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What we claim is:

1. A pump comprising:

a two part housing arrangement having a lower molded housing configured with a rear endbell portion to receive an armature and bearing, an intermediate motor portion to receive a motor shell and magnets arranged around the armature, and a front endbell portion to receive a diaphragm support plate and a wobble plate assembly; the rear endbell portion, the intermediate motor portion and the front endbell portion being configured as an integrated molded housing unit formed as one piece so that there is no leak path either between the rear endbell portion and the intermediate motor portion, or between the intermediate motor portion and the front endbell portion, and an upper housing having a circumferential rim portion, and being configured to receive a check valve assembly; and a diaphragm assembly comprising the diaphragm support plate and a diaphragm, the diaphragm assembly being arranged between the front endbell of the lower molded housing and the circumferential rim portion of the upper housing, so as to form a circumferential fluid-tight sealing arrangement that is configured between the diaphragm support plate, the diaphragm, and the circumferential rim portion when the lower molded housing is coupled to the upper housing on only one end of the pump.

2. The pump according to claim 1, wherein the diaphragm is configured with two circumferential diaphragm sealing surfaces; and the circumferential rim portion is configured to cause at least part of a circumferential fluid-tight seal between the two circumferential diaphragm sealing surfaces and corresponding sealing surfaces of the check valve assembly and the diaphragm support plate when the front endbell is assembled and coupled to the upper housing.

3. The pump according to claim 2, wherein the two circumferential diaphragm sealing surfaces comprise:

a first circumferential diaphragm sealing surface on a first side configured to make sealing contact with a corresponding circumferential sealing surface of the check valve assembly, and a second circumferential diaphragm sealing surface on a second side configured to make sealing contact with a circumferential support plate sealing surface of the diaphragm support plate.

4. The pump according to claim 2, wherein the pump comprises a further circumferential seal or sealing arrangement configured between a circumferential portion of the front endbell portion and a corresponding circumferential portion of the diaphragm support plate, so as to form another part of the circumferential fluid-tight seal between the front endbell portion and the upper housing.

5. An encapsulated diaphragm pump comprising:

a two part housing arrangement having a lower molded housing configured with a rear endbell portion to receive an armature and bearing, an intermediate motor portion to receive a motor shell and magnets arranged around the armature, and a front endbell portion to receive a diaphragm support plate and a wobble plate assembly; the rear endbell portion, the intermediate motor portion and the front endbell portion being configured as an integrated molded housing unit formed as one piece so that there is no leak path either between the rear endbell portion and the intermediate motor portion, or between the intermediate motor portion and the front endbell portion, and an upper housing having a circumferential upper housing portion, and being configured to receive a check valve assembly;

a diaphragm assembly comprising the diaphragm support plate and a diaphragm, the diaphragm having two circumferential diaphragm sealing surfaces, the circumferential upper housing portion configured to cause a circumferential fluid-tight seal between the two circumferential diaphragm sealing surfaces and corresponding sealing surfaces of the check valve assembly and the diaphragm support plate when the upper housing is assembled and coupled to the lower molded housing.

6. The encapsulated diaphragm pump according to claim 5, wherein the two circumferential diaphragm sealing surfaces comprise:

a first circumferential diaphragm sealing surface on a first side configured to make sealing contact with a corresponding circumferential sealing surface of the check valve assembly, and a second circumferential diaphragm sealing surface on a second side configured to make sealing contact with a circumferential support plate sealing surface of the diaphragm support plate.

7. The encapsulated diaphragm pump according to claim 6, wherein the circumferential upper housing portion is configured as a circumferential rim.

8. The encapsulated diaphragm pump according to claim 6, wherein the first circumferential diaphragm sealing surface is configured to receive, engage and interlock with the corresponding circumferential sealing surface of the check valve assembly.

9. The encapsulated diaphragm pump according to claim 8, wherein the first circumferential diaphragm sealing surface is configured with inner and outer circumferential diaphragm sealing rims so as to form a U-shaped circumferential diaphragm sealing channel.

10. The encapsulated diaphragm pump according to claim 8, wherein the corresponding circumferential sealing surface of the check valve assembly is configured with corresponding inner and outer circumferential sealing rims so as to form a U-shaped circumferential sealing channel.

11. The encapsulated diaphragm pump according to claim 8, wherein the first circumferential diaphragm sealing surface is configured with inner and outer circumferential diaphragm sealing rims so as to form a U-shaped circumferential diaphragm sealing channel; and the corresponding circumferential sealing surface of the check valve assembly is configured with corresponding inner and outer circumferential sealing rims so as to form a corresponding U-shaped circumferential sealing channel.

12. The encapsulated diaphragm pump according to claim 11, wherein the U-shaped circumferential diaphragm sealing channel is configured to receive the outer circumferential sealing rim of the check valve assembly, and the corresponding U-shaped circumferential sealing channel of the check valve assembly is configured to receive the inner circumferential diaphragm sealing rim.

13. The encapsulated diaphragm pump according to claim 11, wherein the outer circumferential diaphragm sealing rim is configured to contact the corresponding outer circumferential sealing rim of the check valve assembly, and the corresponding inner circumferential sealing rim of the check valve assembly is configured to contact the inner circumferential diaphragm sealing rim.

14. The encapsulated diaphragm pump according to claim 13, wherein the upper housing also comprises a circumferential extended rim portion configured to engage the outer circumferential diaphragm sealing rim.

15. The encapsulated diaphragm pump according to claim 5, wherein the circumferential fluid-tight seal is configured as a circumferential interlocking seal formed about and between respective sealing surfaces of the diaphragm and check valve assembly, corresponding to where the molded housing and the upper housing come in contact and meet.

16. The encapsulated diaphragm pump according to claim 5, wherein the pump comprises a further circumferential seal or sealing arrangement configured between a circumferential front endbell portion of the front endbell portion and the diaphragm support plate.

17. The encapsulated diaphragm pump according to claim 5, wherein the molded housing is molded around the motor shell.

18. The encapsulated diaphragm pump according to claim 5, wherein the rear endbell portion is configured to form a cavity portion dimensioned to receive a tolerance ring to fit the bearing in the cavity portion.

19. The encapsulated diaphragm pump according to claim 5, wherein the intermediate motor portion has a substantially cylindrical shape, and the front endbell portion has a flared-out shape so as to spread outwardly from intermediate motor portion.

20. The encapsulated diaphragm pump according to claim 19, wherein the upper housing has a corresponding flared-out shape for mating with the front endbell.

* * * * *